US005323672A

United States Patent [19]

Skiba

[11] Patent Number: 5,323,672

[45] Date of Patent: Jun. 28, 1994

[54] LOCKING ASSEMBLY FOR MAINTAINING A BOX WRENCH ENGAGED WITH A BOLTHEAD

[76] Inventor: Carl E. Skiba, 6395 N. Alamando Rd., Coleman, Mich. 48618

[21] Appl. No.: 981,524

[22] Filed: Nov. 25, 1992

[51] Int. Cl.[5] ..... B25B 13/02

[52] U.S. Cl. ..... 81/125; 81/177.85; 279/79

[58] Field of Search ..... 81/125, 177.85, 180.1; 279/76, 79; 403/326, 327, 329

[56] References Cited

U.S. PATENT DOCUMENTS 2,220,354 11/1940 Sheetz ..... 81/125
2,851,295 9/1958 Chaffee ..... 81/177.85 X
3,127,153 3/1964 Elders ..... 279/79 X
3,286,749 11/1966 Learned ..... 81/125 X
4,823,652 4/1989 Morrissey et al. ..... 81/125

*Primary Examiner*—James G. Smith
*Attorney, Agent, or Firm*—Terry M. Gernstein

[57] ABSTRACT

A locking assembly is placed in a web area of a box wrench and includes a ball that is resiliently biased outwardly of the plane of that web into a position to engage one surface of a bolthead. The engagement between the ball and the bolthead maintains the box wrench engaged with the bolthead. The ball can be forced back into the web area to permit the wrench to move past the bolthead. The ball is biased outwardly by a resilient pad. In another form of the invention, a resilient snap ring maintains the ball in the web area, with a ball seating surface being defined in that web area The ball is held in place by edges of either a housing or by edges positioned on the web area.

4 Claims, 10 Drawing Sheets

LOCKING ASSEMBLY FOR MAINTAINING A BOX WRENCH ENGAGED WITH A BOLTHEAD

TECHNICAL FIELD OF THE INVENTION

The present invention relates to the general field of hand tools, and to the particular field of wrenches, specifically box wrenches.

BACKGROUND OF THE INVENTION

A box wrench, also known as a socket wrench, has a head that fits completely around a bolthead for applying torque to that bolthead. The box wrench also has a handle attached to the head and a user manipulates the handle to move the bolthead. The box wrench has the advantage of totally surrounding the bolthead whereby torque application is maximized. Box wrenches have been used for a wide variety of applications for many years.

While quite successful, box wrenches do have a drawback. A large box wrench may have a very long handle and/or be quite heavy. In either case, it may be difficult to keep the box head engaged around the bolthead as that box head may tend to slip off of that bolthead under the influence of gravity. In some situations, it may even be necessary to have two people operate a box wrench, in which one person's job is simply to hold the box wrench head on the bolthead.

Accordingly, there is a need for a box wrench that can be maintained engaged with a bolthead by one user, even if the wrench is quite heavy or has a very long handle, yet which can be easily dropped past a bolthead when desired.

OBJECTS OF THE INVENTION

It is a main object of the present invention to provide a box wrench that will remain engaged with a bolthead, even if the box wrench is quite heavy and cumbersome.

It is another object of the present invention to provide a box wrench that can be maintained engaged with a bolthead by one user.

It is another object of the present invention to provide a box wrench that can be maintained engaged with a bolthead by one user, even when the box wrench is quite long and cumbersome to use.

It is another object of the present invention to provide a box wrench that can remain engaged with a bolthead when desired, yet which can easily be dropped past the bolthead when desired.

SUMMARY OF THE INVENTION

These, and other, objects are achieved by a locking assembly that is mounted adjacent to a box head of a wrench. The locking assembly has an element that engages a bolthead to keep the box head engaged with the bolthead, yet which can be moved out of the way to permit the box head to move past the bolthead when desired.

Specifically, the locking assembly includes a ball inside of a housing that is mounted in a web of a box head. The ball engages either a top surface or a bottom surface of a bolthead when the box head is in surrounding relationship with the bolthead. In this manner, the ball prevents the boxhead from moving off of the bolthead. However, the locking assembly further includes a resilient element in the housing that biases the ball into bolthead-engaging position. The ball can be forced out of the bolthead-engaging position against the bias of the resilient means whereby the box head can be moved past the bolthead when desired.

BRIEF DESCRIPTION OF THE DRAWING FIGURES

DETAILED DESCRIPTION OF THE PREFERRED EMBODIMENT OF THE INVENTION

Figure 1:
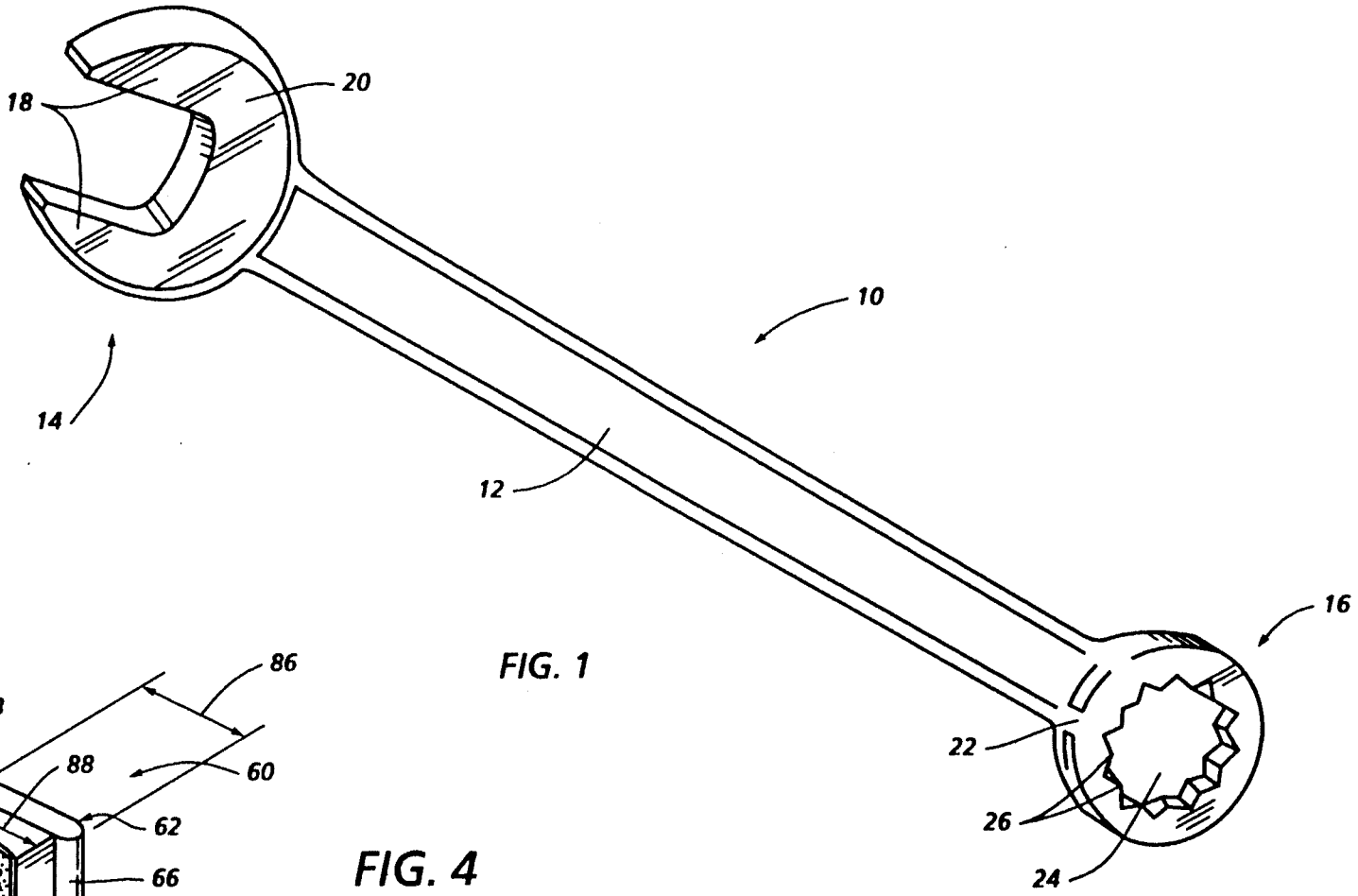
FIG. 1 is a top and end perspective view of a wrench having a box end and an open end.

Shown in FIG. 1 is a conventional wrench 10 having a handle 12 with an open end 14 on one end and a box end 16 on the other end. The open end 14 includes two jaws 18 and a web area 20 for engaging a bolthead. The box end 16 includes a web area 22 surrounding a box area 24 on which a multiplicity of points 26 for engaging a bolthead.

Figure 2:
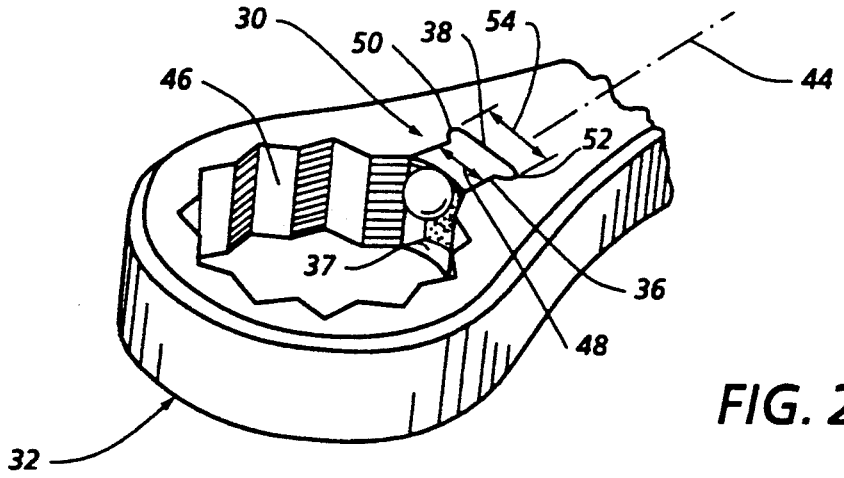
FIG. 2 is a perspective view of a box end of a wrench, including a locking assembly of the present invention.
Figure 3:
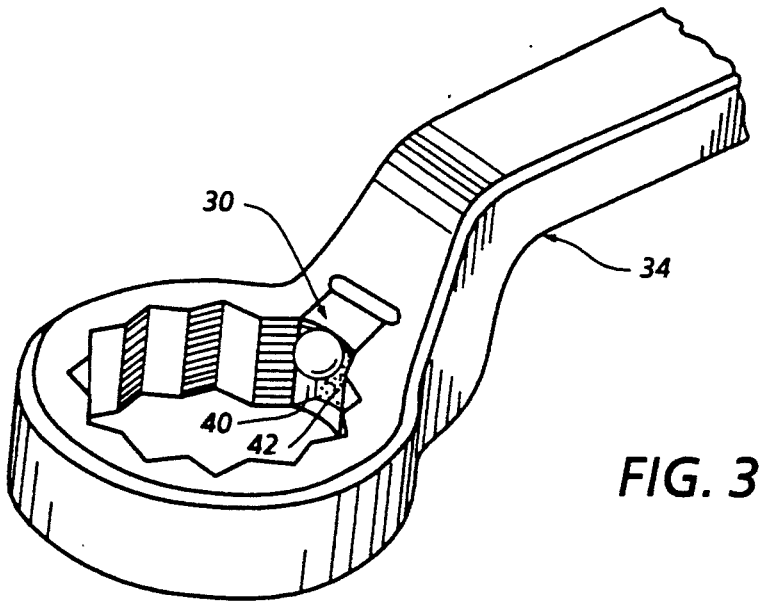
FIG. 3 is a perspective view of an offset box end of a wrench, including a locking assembly of the present invention.
Figure 5:
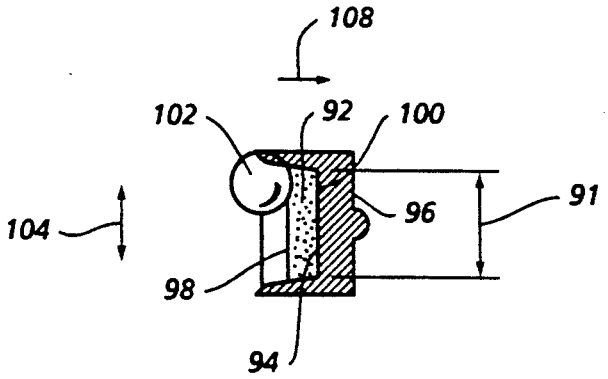
FIG. 5 is a cutaway side elevational view of the locking assembly of the present invention.
Figure 6:
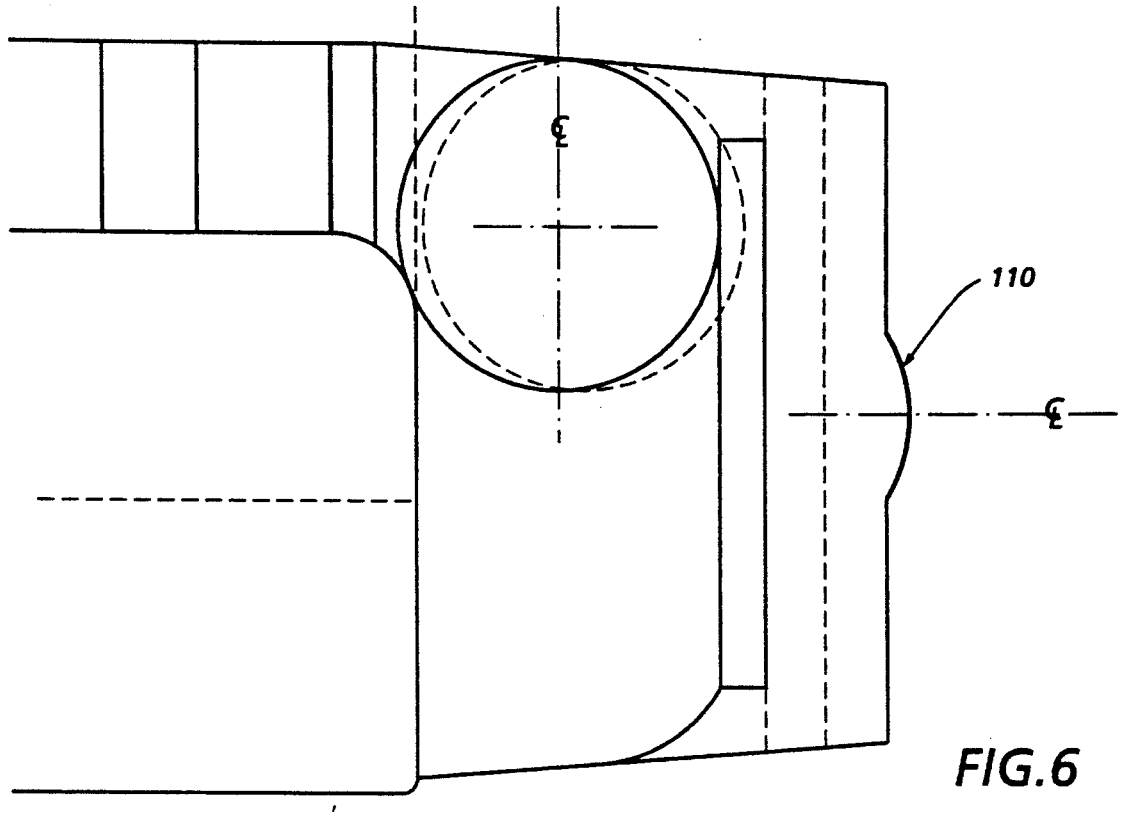
FIG. 6 is an enlarged cutaway side elevational view of the locking assembly engaged with a bolthead.
Figure 7:
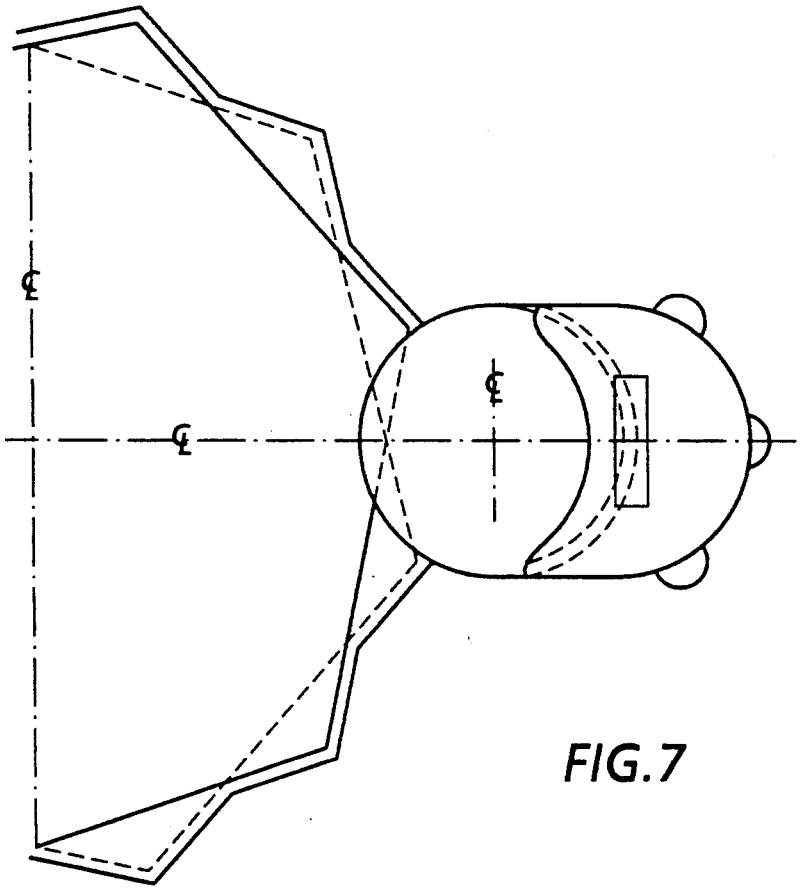
FIG. 7 is a top plan view of the locking assembly engaged with a bolthead.

The present invention is embodied in a locking assembly for maintaining the box end engaged with a bolthead. The locking assembly 30 is shown in FIG. 2 in flush box end 32 and in FIG. 3 in an offset box head 34.

Referring to FIGS. 2 through 7, a housing slot 36 is defined in the web area 22 adjacent to the box area 24. The housing slot includes a front section 37 and a rear section 38. The front section includes two parallel side walls 40 and 42 extending along longitudinal centerline 44 of the handle from inner surface 46 of the web area towards the open end 14. The side walls are spaced apart by a slot width dimension 48. The rear section 38 of the housing slot includes two wing-receiving slots 50 and 52 that define a width dimension 54 for the rear area that exceeds width dimension 48.

Figure 4:
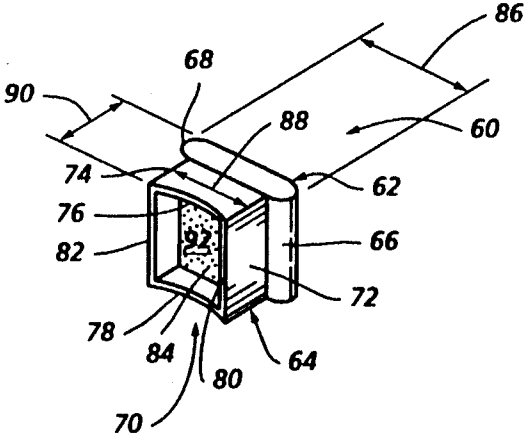
FIG. 4 is a front perspective view of a housing for the locking assembly of the present invention.
Figure 9:
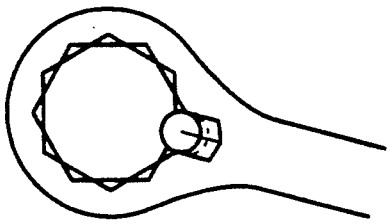
FIG. 9 is a top plan view of a box head engaged with a bolthead illustrating the method of using the locking assembly of the present invention.
Figure 14:
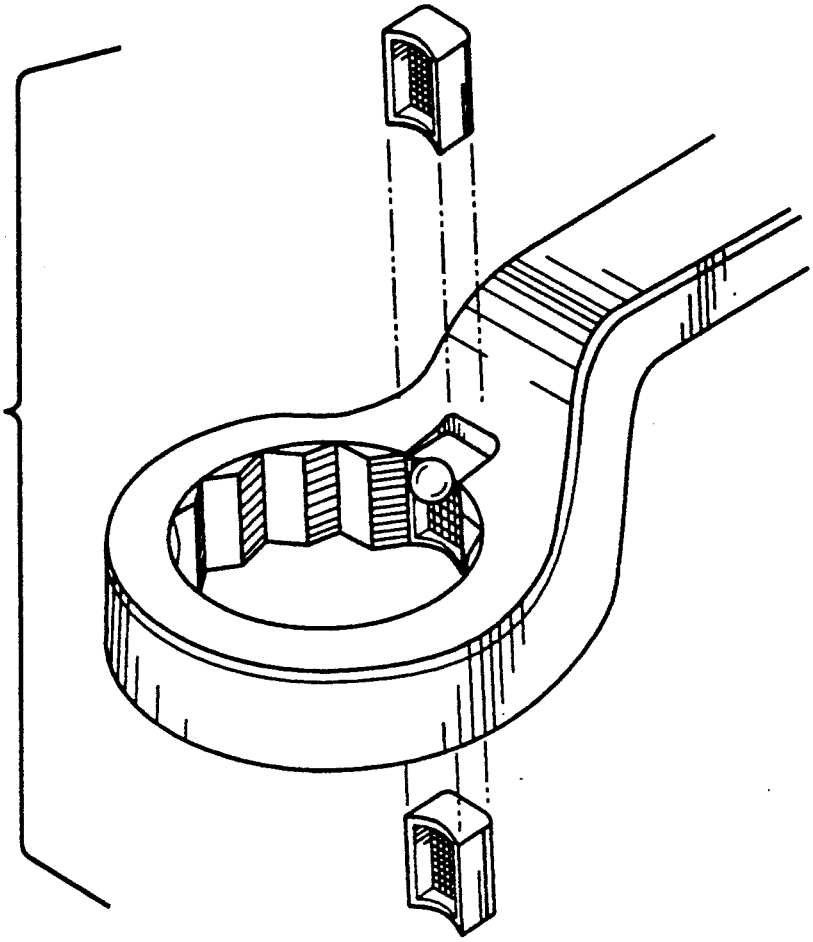
FIG. 14 is an exploded top, side and end perspective view of another form of the invention.
Figure 15:
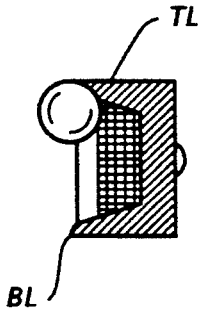
FIG. 15 is a cutaway side elevational view of the ball locking assembly keeper used in the FIG. 14 form.
Figure 10B:
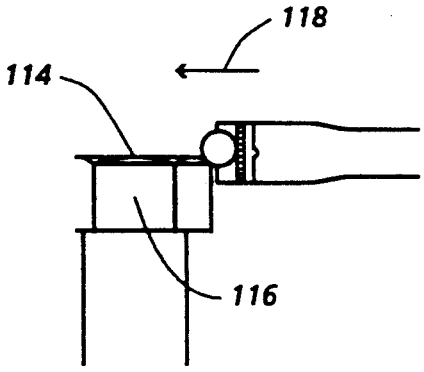
FIG. 10B is a side elevational view of the FIG. 10A step.
Figure 10A:
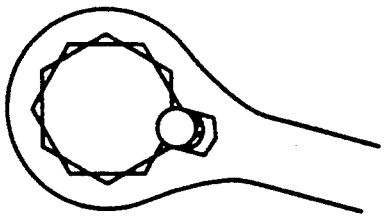
FIG. 10A is a top plan view of the ball of the locking assembly engaged with a bolthead illustrating the method of using the locking assembly of the present invention.

A housing element 60 is slidably mounted in the housing slot 36, and includes a rear portion 62 to which is connected a forward portion 64. The rear portion 62 includes two wings 66 and 68 that are sized and shaped to be slidably received in the wing-receiving slots 50 and 52. The forward portion 64 includes a top wall 68, a bottom wall 70 and two side walls 72 and 74. The walls all terminate in forward ends 76, 78, 80 and 82 respectively, with ends 76 and 78 being arcuate. As is best shown in FIG. 9, wall forward ends 80 and 82 curve toward each other. This curvature is not seen in FIG. 4 because FIG. 4 is a perspective view. These forward ends 80 and 82 define a housing slot 84 therebetween, with this housing slot having a slot width. The housing has a rear width dimension 86 defined between the outer-most tangential locations of wings 66 and 68 that is essentially equal to the housing width dimension 54, but is slightly less than such dimension so the housing can slide into and out of the housing slot. The housing further has a forward width dimension 88 defined between the two side walls 72 and 74 which is slightly less than the slot width dimension 48 so the housing can be slidably received in that slot. The housing has a depth dimension 90 that is defined between the rearmost surface of the rear portion and the plane containing the slot 84 defined between forward ends 80 and 82, and a height dimension 91 that is measured between the inner surface of the top and bottom walls 68 and 70.

A resilient pad 92 of felt material, or the like, is mounted on inner surface 94 of the rear wall 96 of the housing. The depth dimension 90 is measured from the inner surface 94. The pad 92 has a front surface 98 and a rear surface 100, with a thickness measured between the front and rear surfaces 98 and 100 respectively. The thickness of the pad 92 reduces the depth dimension of the housing by the amount of the thickness.

Figure 8:
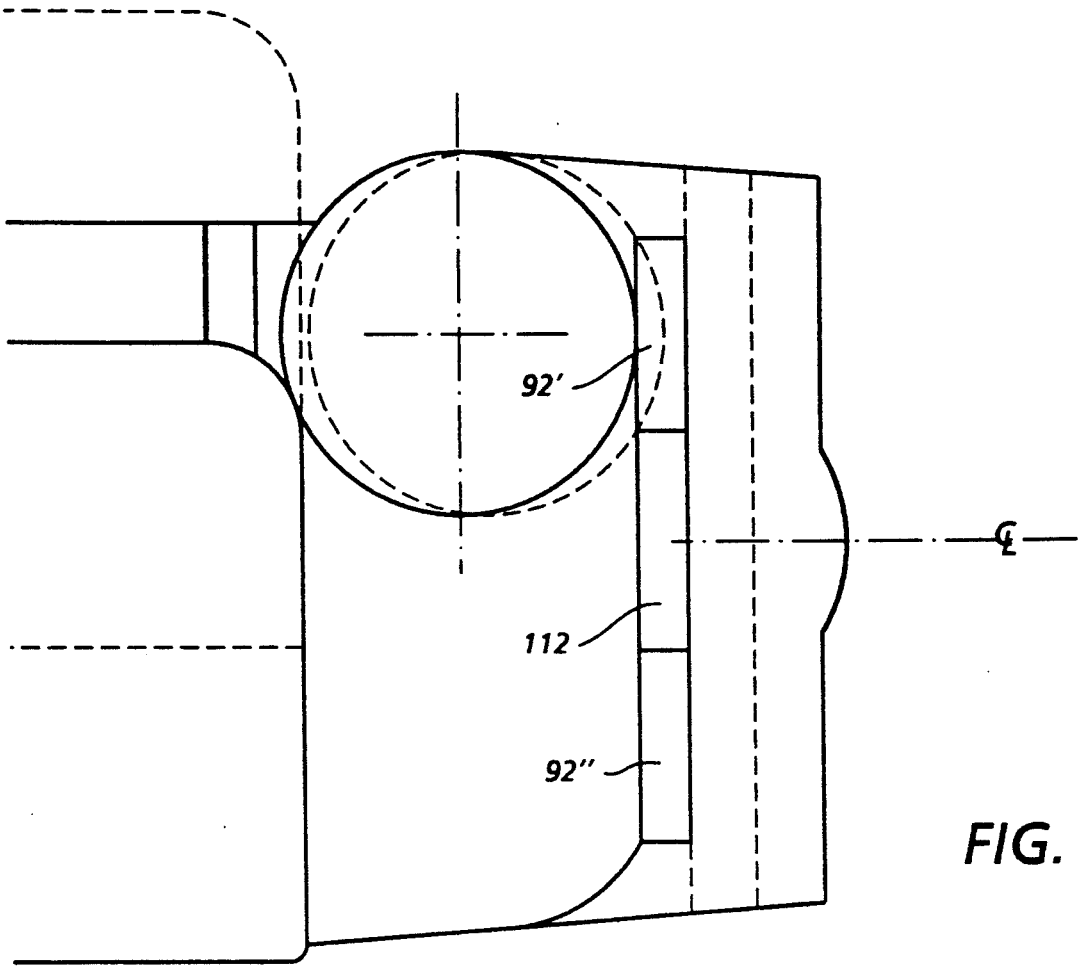
FIG. 8 is an enlarged cutaway side elevational view of another form of the locking assembly of the present invention.

The locking element further includes a ball 102, such as a ball bearing or the like, located inside the housing. The ball is spherical and has an outer diameter that is selected to permit the ball to move freely within the housing in the vertical direction 104, but to be positioned to protrude out of the housing and to be held by the wall forward ends 80 and 82 so it will not fall out of the housing. Therefore, the ball has an outer diameter that is less than the housing height dimension 91, less than the housing depth dimension 90 and greater than the width dimension of slot 84 and less than the housing width dimension 88. This dimension of the ball vis a vis the housing depth dimension causes the ball to protrude out of the housing via the slot 84 when the ball rests against the pad front surface 98. Pressing the ball against the pad causes the pad to give and causes the ball to move in direction 108 and into the housing. The thickness of the pad is selected so that such pressing the ball in direction 108 will cause the pad to compress sufficiently to permit the ball to move far enough into the housing to have the outermost tangential location of the ball flush with the plane containing the slot 84. That is, the ball protrudes out of the housing a distance as measured along the ball diameter that corresponds to the thickness of the pad. To ensure that the ball can be moved totally inside the housing, the housing contains a concave indentation 110 (see FIG. 6). The ball thus moves from the outwardly projecting position shown in FIG. 5 to an inward location shown in FIG. 6 in which the ball has compressed the pad. As shown in FIG. 8, the pad can include two spaced apart portions 92′ and 92″ with a gap 112 defined therebetween.

Operation of the locking apparatus is illustrated in FIGS. 9 through 11B. Ball 102 engages top surface 114 of a bolthead 116 to prevent the wrench box end from slipping off of that bolthead as is best seen in FIG. 10B. The wrench is operated in the normal manner. However, if it is desirable to move the box end past the bolthead, the wrench is pressed forward in direction 118 to press the ball against the bolthead and force the ball against the pad in direction 108. This causes the pad to give and moves the ball into the housing from the FIG. 10B position into the FIG. 11B position. With the ball fully inside the housing, the wrench can be moved past the bolthead. The resilient pad thus biases the ball into the locking position, but such bias can be overcome to move the ball out of the locking position. The housing thus can be seen as having two depth dimensions, one being measured between the pad front surface 98 and the plane containing slot 84 and a second depth dimension measured between the pad rear surface 100 and the plane containing the slot 84. The diameter of the ball element is larger than the first depth dimension but is smaller than the second depth dimension so the ball will protrude when the pad element is not compressed. The pad element can be of different thicknesses so that it need not be completely compressed (i.e., will have some thickness remaining) when the ball element has moved into the housing far enough to permit the bolthead to clear the box wrench.

The box wrench can include six or twelve points as is known to those skilled in the art.

Additional forms of the invention are shown in FIGS. 12 through 21. While the basic concept associated with the above-discussed forms applies to the forms shown in FIGS. 12 through 21, these forms differ slightly from each other and from the above-discussed forms in structural elements. Therefore, the operation and use of these forms will not be presented as these forms operate in a manner that is similar to the above-discussed forms in permitting a wrench to be placed on a nut and held in place on that nut. Any variations between the operation of these forms of the invention and the forms disclosed in the above-discussed FIGS. will be apparent to one skilled in the art based on the teaching of this disclosure.

Figure 12:
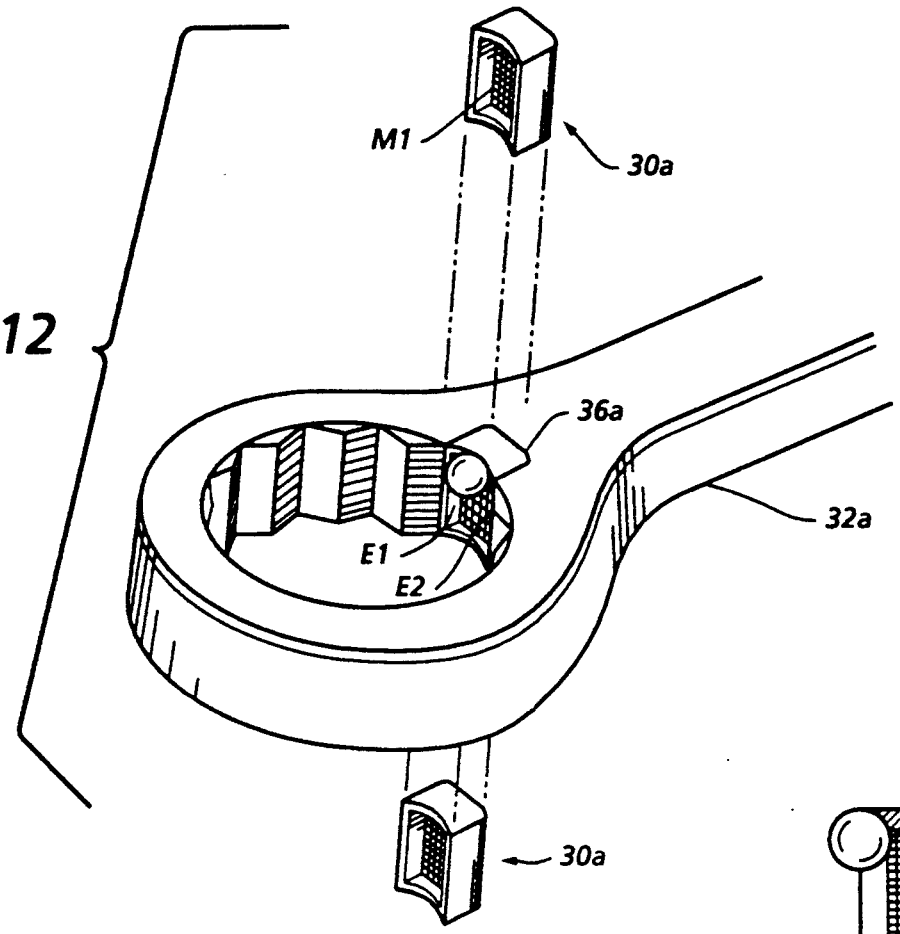
FIG. 12 is an exploded top, side and end perspective view of another form of the invention.
Figure 13:
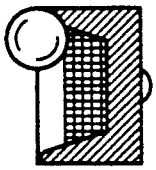
FIG. 13 is a cutaway side elevational view of the ball locking assembly keeper used in the FIG. 12 form.
Figure 11B:
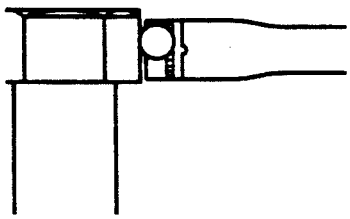
FIG. 11B is a side elevational view of the FIG. 11A step.
Figure 11A:
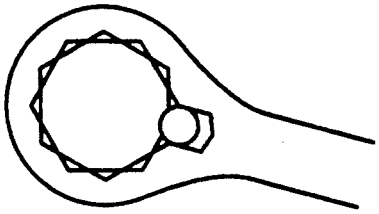
FIG. 11A is a top plan view of the ball of the locking assembly disengaged from a bolthead illustrating the method of using the locking assembly of the present invention.

A locking assembly 30*a* is shown in combination with a wrench 32*a* in FIG. 12. The assembly 30*a* can slide into and out of a housing slot 36*a* defined in the web area of the wrench. The assembly has a rectangular shape and the slot in the wrench has a corresponding shape. The FIG. 12 assembly differs from the FIG. 2 assembly by deleting the wings. Assembly 30*a* can slide into and out of the wrench web section from either direction as indicated in FIG. 12. As discussed above, the wrench web section is machined to hold the ball in assembly. This is indicated in FIG. 12 where the wrench web includes two edges E1 and E2 that extend adjacent to the ball and are spaced from each other a distance that is selected to hold the ball in the assembly. For example, the spacing between edges E1 and E2 is less than the diameter of the ball. The ball moves within the assembly up and down and rearwardly as discussed above so the wrench can be placed on a nut from above or below, yet the ball will engage a surface of the nut to hold the wrench in place on that nut. However, since the assembly includes a soft mesh M1 in the rear thereof, the ball can be forced back into the assembly into the mesh to allow a nut to by-pass the ball. As will be appreciated by those skilled in the art the housing of the assembly includes a top lip (see FIG. 15, however, all assembly housings will have similar structure) TL and a bottom lip BL that extend far enough outwardly beyond the ball to prevent that ball from moving out of the housing, while the above-discussed structure of the wrench itself prevents the ball from falling out of the housing. The sketches of FIG. 15 and corresponding figures appear to show the ball held in a housing in a manner that will permit the ball to fall out of the housing, but this showing is for convenience only, and the ball is held in the assembly by the lips and edges as above described extending beyond the end of the housing far enough to keep the ball in the housing while permitting that ball to move up and down as above described.

Figure 16:
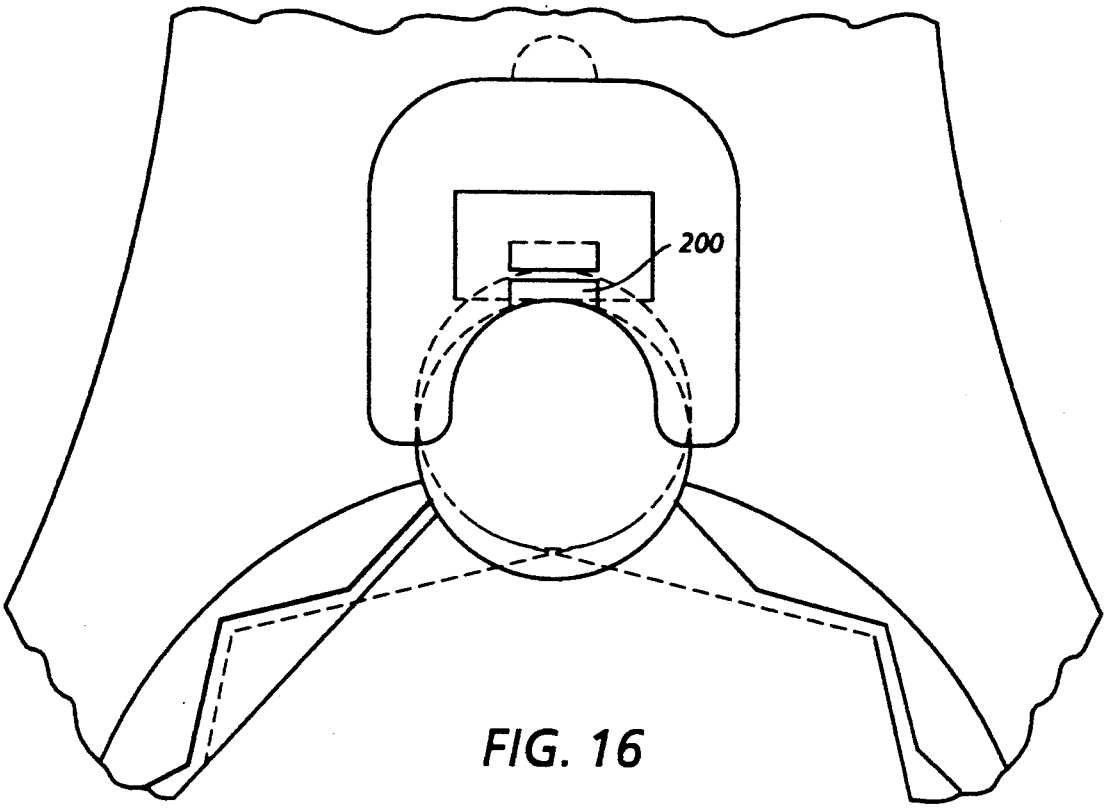
FIG. 16 is a top plan view of another form of a wrench embodying the invention.
Figure 17:
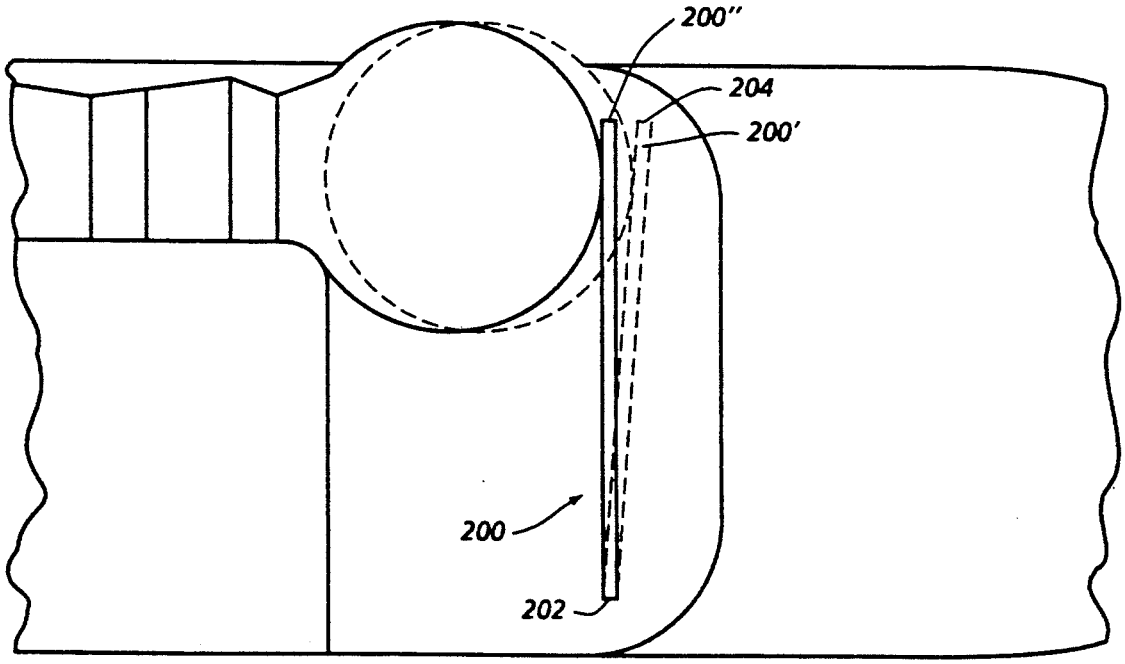
FIG. 17 is a cutaway side elevational view of the FIG. 16 form of the invention.
Figure 18:
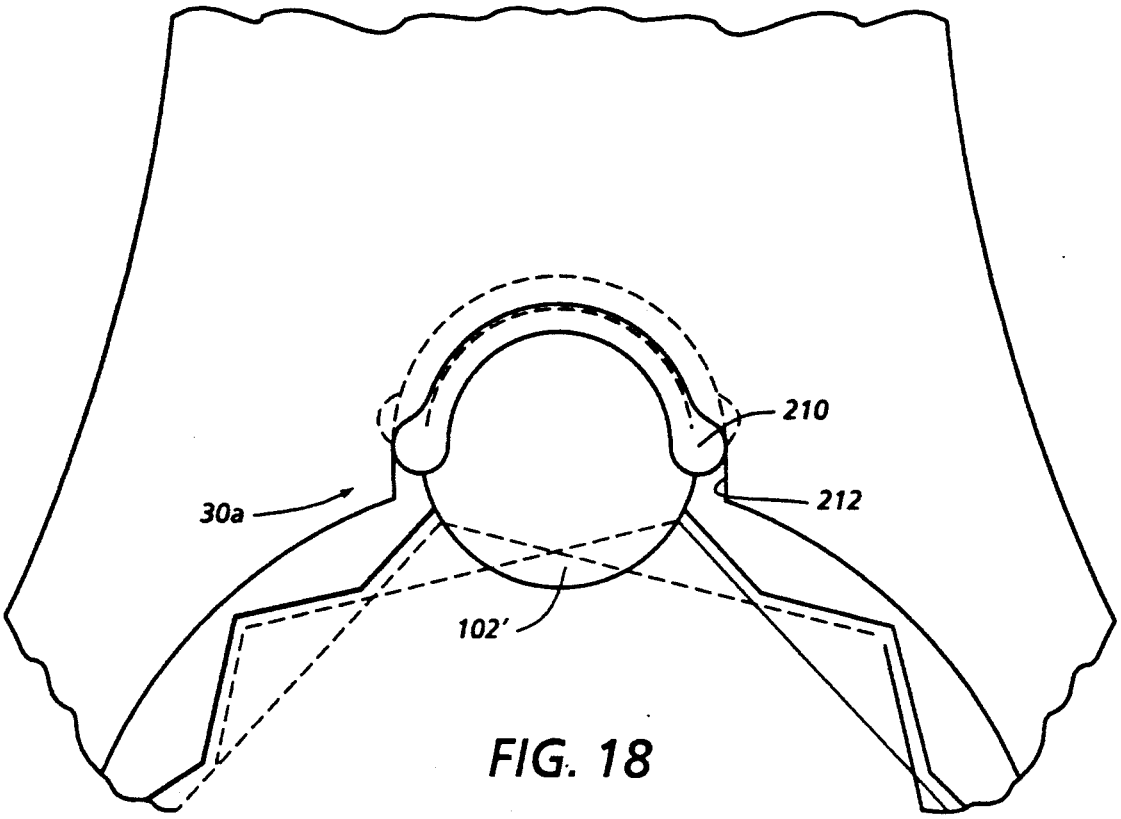
FIG. 18 is a top plan view of another form of a wrench embodying the invention.
Figure 19:
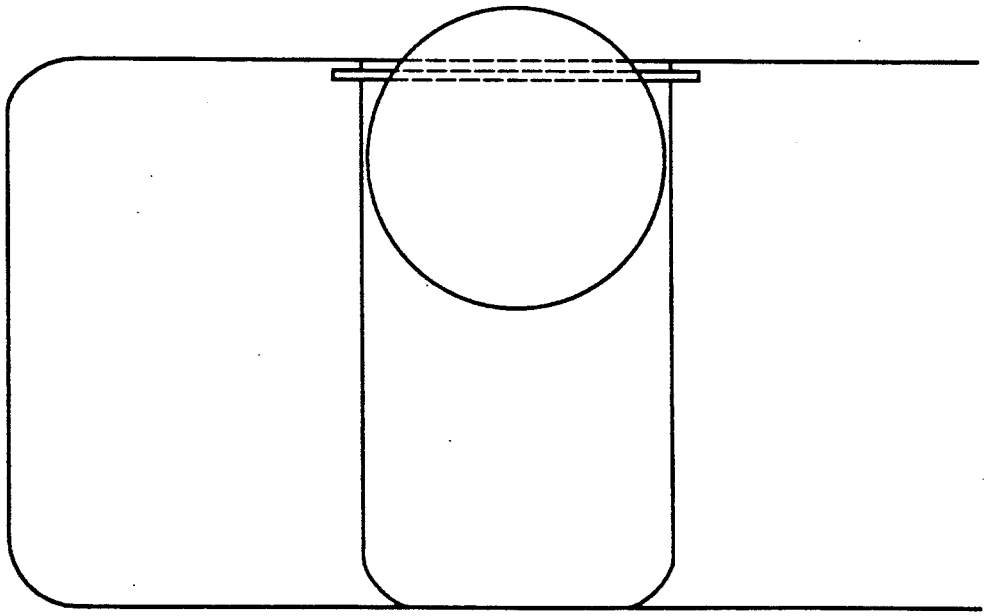
FIG. 19 is a front elevational view of the keeper shown in FIG. 18.
Figure 20:
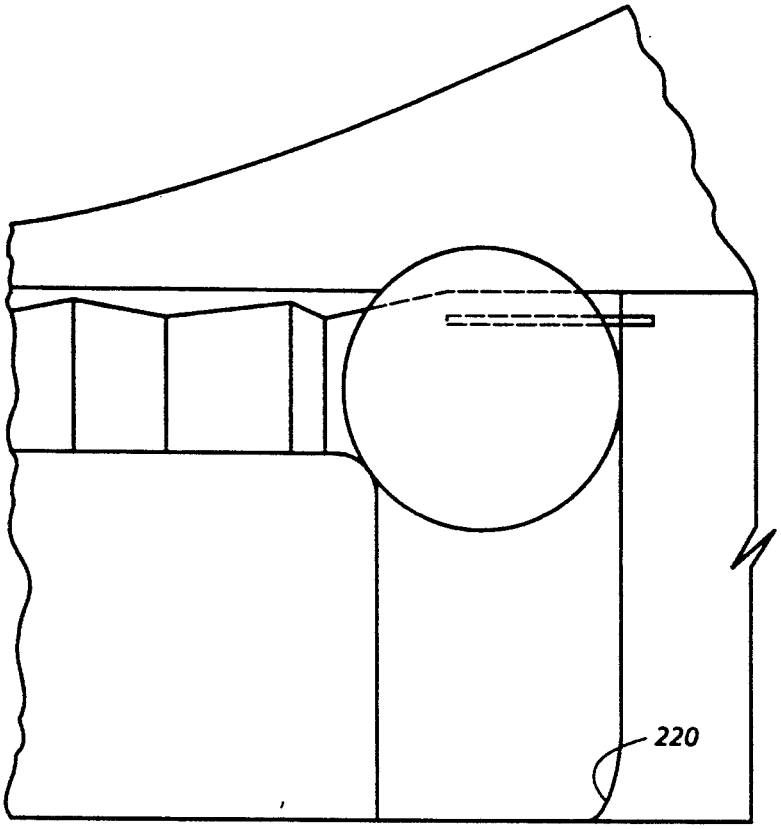
FIG. 20 is a side elevational view of the keeper shown in FIG. 18.
Figure 21:
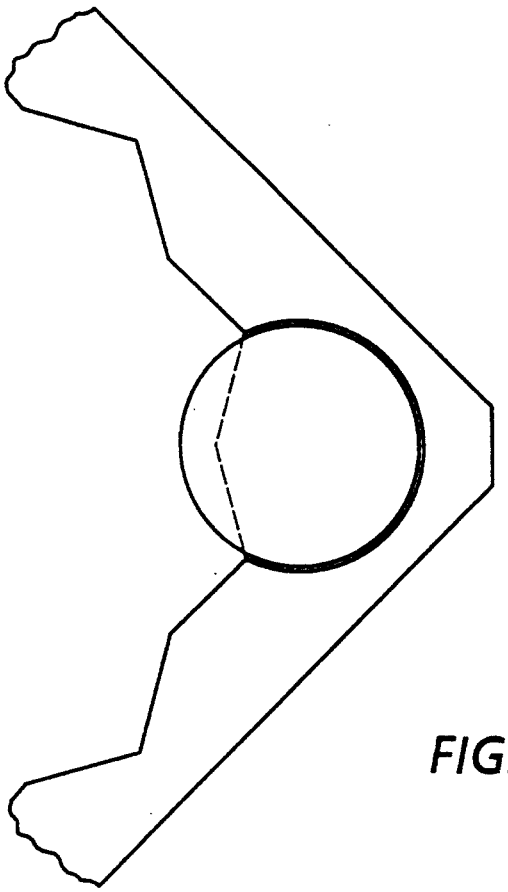
FIG. 21 is a top plan view of the FIG. 18 form of the invention.

FIGS. 16 and 17 show another form of the invention in which a planar plate 200 is embedded in the resilient pad 92. The plate 200 has a lower end 202 and an upper end 204. The plate controls movement of the ball from the full line position shown in FIGS. 16 and 17 to the dotted line position shown in those figures. The plate pivots about one end or the other depending on which end the ball is adjacent, between a dotted line position 200' when the ball is forced into the resilient pad to permit a nut to pass into or out of the wrench and a full line position 200'' when the ball is in a nut blocking position shown in full lines.

Yet another form of the invention is shown in FIGS. 18–21 as assembly 30*a*. Assembly 30*a* includes a resilient snap ring 210 is fixedly mounted to the wrench in an opening 212. The snap ring holds ball 102' in the opening 212. The ball 102' is positioned in the opening 212 to protrude therefrom far enough to prevent a nut from passing by that ball. The ball 102' does not move into or out of the opening as the balls discussed above which are mounted on a resilient pad. No such pad is present in assembly 30*a*, accordingly, a wrench including assembly 30*a* must be lifted onto and off of a nut.

The opening 212 includes a ball seating surface 220 that causes the ball to move outwardly of the slot into a nut abutting position. In the position shown in FIG. 20, a nut will abut the ball, with the ball engaging the snap ring. This will cause the wrench to be fixed to the nut. The wrench is lifted off of the nut to free it from the nut. The ball can move to another position engaging the surface 220 and, again, be forced into a nut engaging position.

Figure 22:
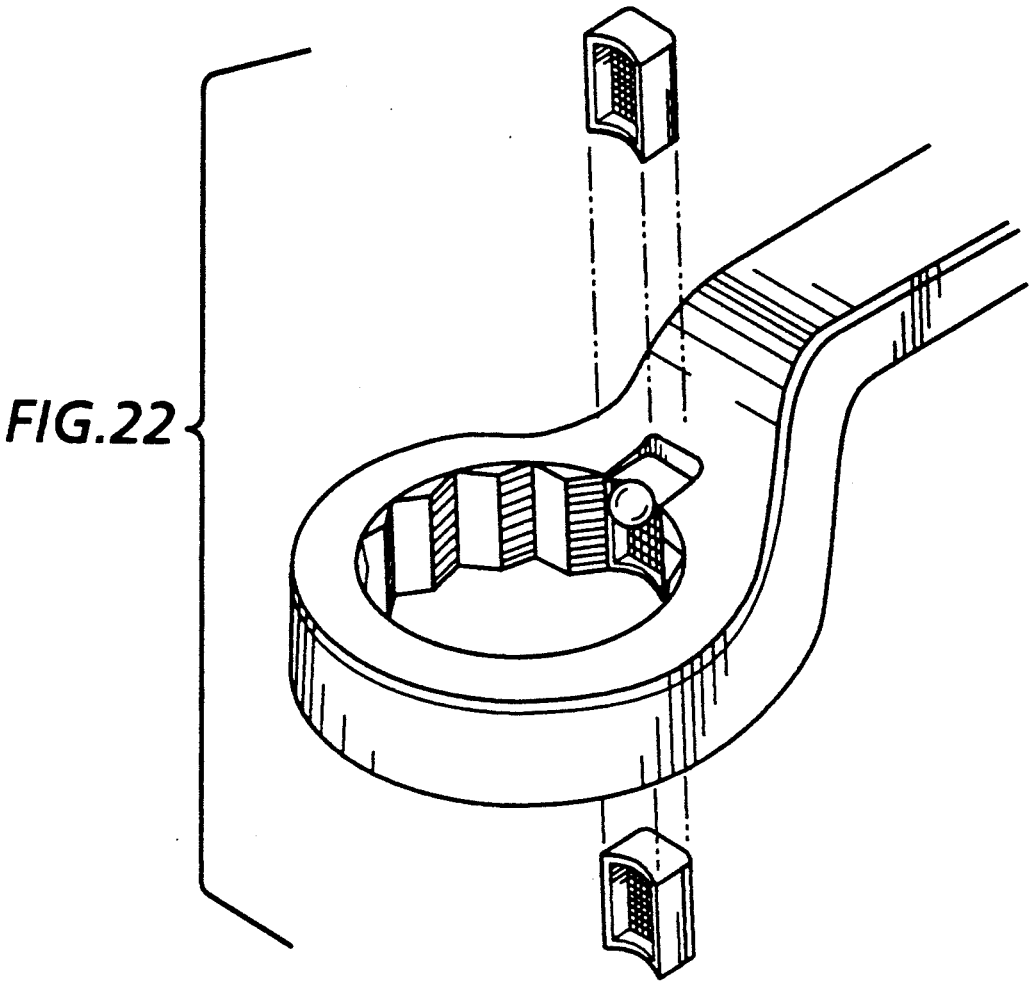
FIG. 22 is a perspective view of another form of the invention.
Figure 23:
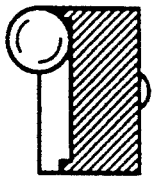
FIG. 23 is a perspective view of the assembly used in conjunction with the FIG. 22 form of the invention.

In some instances, a resilient pad is not desired. Accordingly, another form of the invention, shown in FIGS. 22 and 23, includes an assembly 250 that excludes any resilient pad. The assembly 250 thus has a solid housing 252 against which the ball rests. As is the case in all forms of the invention, the housing 252 includes a projection 254 that engages a corresponding dimple in the wrench to hold the housing in position in the wrench. The projection co-operates with a slip fit established between the housing and the wrench slot to hold the housing in the wrench. That is, the housing and the slot are sized with respect to each other whereby the housing slides into the slot but will have a tight fit whereby friction holds the housing securely in place.

It is understood that while certain forms of the present invention have been illustrated and described herein, it is not to be limited to the specific forms or arrangements of parts described and shown.

I claim:

1. A locking assembly for releasably securing a box wrench to a bolthead, the box wrench including a housing slot defined in a box end web area of a box wrench, the housing slot having a forward portion and a rear portion, a forward portion width dimension, a rear portion width dimension and a depth dimension, the rear portion including two wing-receiving slots with the rear portion width dimension extending between the wing-receiving slots, the rear portion width dimension being greater than the forward portion width dimension, comprising;

A) a housing element slidably received in said housing slot and having a forward section and a rear section, said rear section having two wings each of which is sized to be slidably received in one of said wing-receiving slots, said forward section including a rear wall, a top wall, a bottom wall and two side walls, said side walls being connected at a rear end thereof to said rear section adjacent to said wings and having a forward edge spaced from said rear section, the forward edges of said side walls being curved towards each other and being spaced apart by a forward slot having a width dimension measured between said side wall forward ends, said housing element having a depth dimension defined between an inner surface of said rear wall and a plane containing said forward slot, a height dimension defined between said top and bottom walls, a forward width dimension defined between said side walls;

B) a resilient pad element mounted on an inner surface of said housing element rear wall, said pad element including a rear surface mounted on said inner surface of said rear wall and a front surface facing said housing forward slot, said pad element having a thickness defined between said pad element front and rear surfaces, said pad element thickness decreasing the depth dimension of said housing element so the housing has a second depth dimension measured between said pad element front surface and said forward slot; and C) a ball element in said housing, said ball element being spherical and having an outer diameter and engaging said pad element front surface, said ball element outer diameter being larger than said forward slot width, less than said height dimension, less than said housing forward section width dimension, greater than said housing first depth dimension and less than said housing second depth dimension whereby said ball element protrudes out of said housing forward section through said forward slot when said ball element is in a first position lightly engaging said pad element and is contained within said housing forward section when said ball element is in a second position depressed into said pad element.

2. The locking assembly defined in claim 1 wherein said pad element includes two spaced apart portions.

3. The locking assembly defined in claim 1 wherein said housing further includes a concave depression on said rear wall.

4. A locking assembly for releasably securing a box wrench to a bolthead, the box wrench including a housing slot defined in a box end web area of a box wrench, said housing slot having a forward portion and a rear portion, a forward portion width dimension, a rear portion width dimension and a depth dimension, said housing slot including two forward edges spaced apart by a forward gap, comprising;

A) a housing element slidably received in said housing slot and having a forward section and a rear section, said forward section including a rear wall, a top wall, a bottom wall and two side walls, said side walls being connected at a rear end thereof to said rear section, said housing element having a depth dimension defined between an inner surface of said rear wall and a plane containing said forward gap, a height dimension defined between said top and bottom walls, a forward width dimension defined between said side walls;

B) a resilient pad element mounted on an inner surface of said housing element rear wall, said pad element including a rear surface mounted on said inner wall surface and a front surface facing said housing forward gap, said pad element having a thickness defined between said pad element front and rear surfaces, said pad element thickness decreasing the depth dimension of said housing element so the housing has a second depth dimension measured between said pad element front surface and said forward gap; and C) a ball element in said housing, said ball element being spherical and having an outer diameter and engaging said pad element front surface, said ball element outer diameter being larger than said forward gap less than said height dimension, less than said housing forward section width dimension, greater than said housing first depth dimension and less than said housing second depth dimension whereby said ball element protrudes out of said housing forward section through said forward gap when said ball element is in a first position lightly engaging said pad element and is contained within said housing forward section when said ball element is in a second position depressed into said pad element.

* * * * *